US006877314B2

(12) United States Patent
Pels

(10) Patent No.: US 6,877,314 B2
(45) Date of Patent: Apr. 12, 2005

(54) STIRLING MOTOR AND HEAT PUMP

(76) Inventor: Sander Pels, Stuijvesantsstraat 95 zw, 2023 KM Haarlem (NL)

( * ) Notice: Subject to any disclaimer, the term of this patent is extended or adjusted under 35 U.S.C. 154(b) by 0 days.

(21) Appl. No.: 10/296,228

(22) PCT Filed: May 29, 2001

(86) PCT No.: PCT/NL01/00415

§ 371 (c)(1),
(2), (4) Date: Dec. 4, 2002

(87) PCT Pub. No.: WO01/94769

PCT Pub. Date: Dec. 13, 2001

(65) Prior Publication Data

US 2004/0040297 A1 Mar. 4, 2004

(30) Foreign Application Priority Data

Jun. 6, 2000 (NL) ..... 1015383

(51) Int. Cl.[7] ..... F01B 29/10
(52) U.S. Cl. ..... 60/517; 60/520; 60/525
(58) Field of Search ..... 60/517, 525, 520

(56) References Cited

U.S. PATENT DOCUMENTS 3,319,416 A * 5/1967 Renshaw ..... 60/525
3,552,120 A * 1/1971 Beale ..... 60/525
4,199,945 A * 4/1980 Finkelstein ..... 60/520
4,498,298 A * 2/1985 Morgan ..... 60/525
5,077,976 A 1/1992 Pusic et al.
5,934,076 A 8/1999 Coney

FOREIGN PATENT DOCUMENTS

| | | |
|---|---|---|
| DE | 37 23 289 | 7/1988 |
| WO | 88 05223 | 7/1988 |
| WO | 95 13466 | 5/1995 |

* cited by examiner

*Primary Examiner*—Hoang Nguyen
(74) *Attorney, Agent, or Firm*—Oblon, Spivak, McClelland, Maier & Neustadt, P.C.

(57) ABSTRACT

Stirling engine which may be used as a heat pump, which consists of a hot half and a cold half. Both halves are connected by two lines which constitute a counterflow heat exahnger or in which a counterflow heat exchanger is mounted. Moreover, a mutual shaft, to which in the hot half a large and a small piston are mounted and to which in the cold half a large and a small piston are mounted, connects both parts. For every up or down going movement of the shaft, a complete Stirling cycle is performed. If desired, the shaft may be replaced by a hydraulic interconnection.

6 Claims, 4 Drawing Sheets

STIRLING MOTOR AND HEAT PUMP

Figure 1:
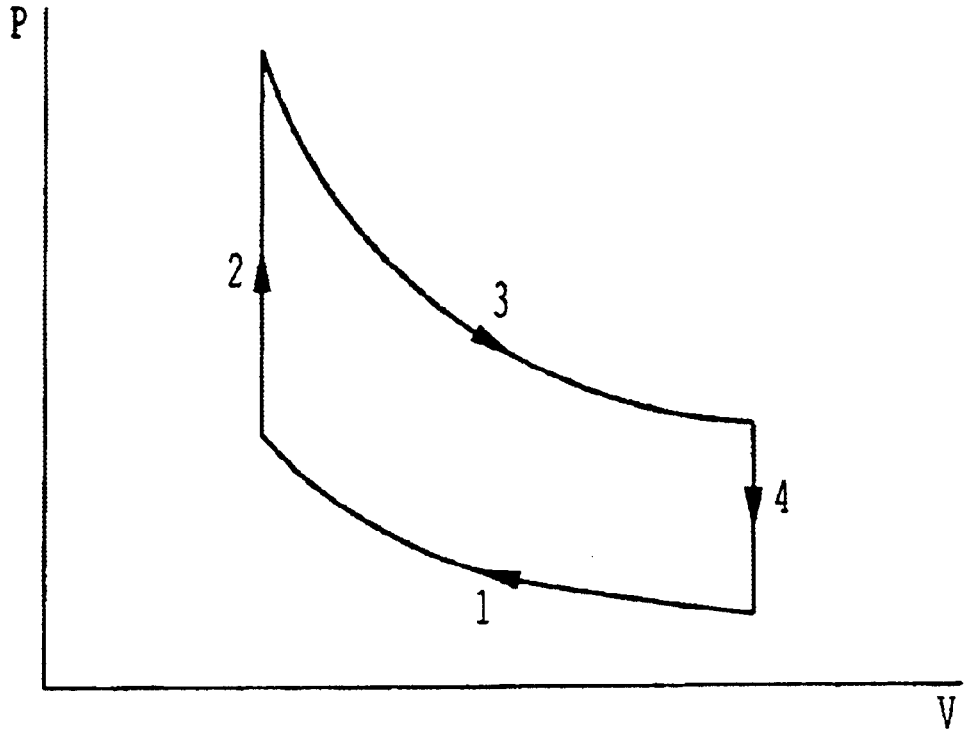

The invention relates to a Stirling motor provided with at least one piston, which is movable in a reciprocating manner in an operationally hot motor part and a cold motor part. The Stirling motor as invented in 1817 by Stirling, consists of a cylinder, which is heated on one side and cooled on another side. In the cylinder a displacer and a piston can move freely. The displacer and the piston are each individually connected to a flywheel. In the Stirling motor a Stirling cycle is executed, during which work can be done by the piston.

The disadvantage of the known Stirling motor is that the heat and the cold must be brought substantially to one location, while in practice a heat source and a cold source are often available on different locations. The Stirling motor according to the invention substantially obviates this disadvantage and is characterized in that the motor comprises a separate hot motor part and cold motor part, which are connected by two tubes and a shaft or a hydraulic interconnection.

A favourable embodiment of the inventive Stirling motor is characterized in that the hot motor part is provided with a first system of two mutually coupled pistons, that the cold motor part is provided with a second system of two mutually coupled pistons and that the shaft or the hydraulic interconnection forms a connection between the first system and the second system. In this manner, the entire isothermal expansion can take place in the hot motor part and the entire isothermal compression can take place in the cold motor part. An additional advantage is that in this way a Stirling motor is obtained which performs a complete and substantially continuous Stirling cycle for every single stroke of the reciprocating pistons.

A further favourable embodiment of the inventive Stirling motor is characterized in that the two tubes are mutually thermally interconnected by a counterflow heat exchanger. Preferably the tubes themselves are closely thermally connected across their entire length, such that they can be used for exchanging heat during the isochorous part of the Stirling cycle.

A favourable embodiment according to another aspect of the invention is characterized in that the first system of coupled pistons comprises a large and a small piston, which can move in a first assembly of a large and a small cylinder and that the second system of coupled pistons comprises a large and a small piston, which can move in a second assembly of a large and a small cylinder. In this embodiment the ratio between the diameters is according to the invention at least substantially determined by the temperature difference to be expected between the heat source and the cold source.

A favourable embodiment according to another aspect of the invention is characterized in that the four cylinders are provided with eight connections and that a system of valves is provided for mutually connecting the eight connections for executing a Stirling cycle. In this way a switchover can be made at the right moment, that means the most optimal moment from one part of the Stirling cycle to the next part.

The invention also relates to a heat pump provided with at least one piston, which can be moved in a reciprocating manner in an operationally hot pump part and a cold pump part. The inventive heat pump is characterized in that the heat pump consists of a separate hot pump part and cold pump part, which pump parts are connected by two tubes and a shaft or a hydraulic interconnection. It is possible then to locate the cold pump part for example in the soil and the heat pump part in a house, in such a manner that all produced heat can be utilised.

A favourable embodiment of the inventive heat pump is characterized in that the hot pump part is provided with a first system of two mutually coupled pistons, that the cold pump part is provided with a second system of two mutually coupled pistons and that the shaft or the hydraulic interconnection forms a connection between the first system and the second system. In this way the isothermal compression may take place completely in the hot pump part and the isothermal expansion completely in the cold pump part. Moreover, in that way a heat pump is obtained which performs for every reciprocating stroke of the pistons a complete and substantially continuous Stirling cycle.

A further favourable embodiment of the inventive heat pump is characterized in that the two tubes are mutually thermally interconnected by a counterflow heat exchanger. Preferably the tubes themselves are closely thermally connected across their entire length, such that they can be used for exchanging heat during the isochorous part of the Stirling cycle.

A favourable embodiment according to another aspect of the invention is characterized in that the first system of coupled pistons comprises a large and a small piston, which can move in a first assembly of a large and a small cylinder and that the second system of coupled pistons comprises a large and a small piston, which can move in a second assembly of a large and a small cylinder. In this embodiment the ratio between the diameters is according to the invention at least substantially determined by the desired temperature difference between the heat source and the cold source.

A favourable embodiment according to still another aspect of the invention is characterized in that the four cylinders are provided with eight connections and that a system of valves is provided for mutually connecting the eight connections for executing a Stirling cycle. In this way a switchover can be made at the right moment, that means the most optimal moment from one part of the Stirling cycle to the next part.

Figure 2:
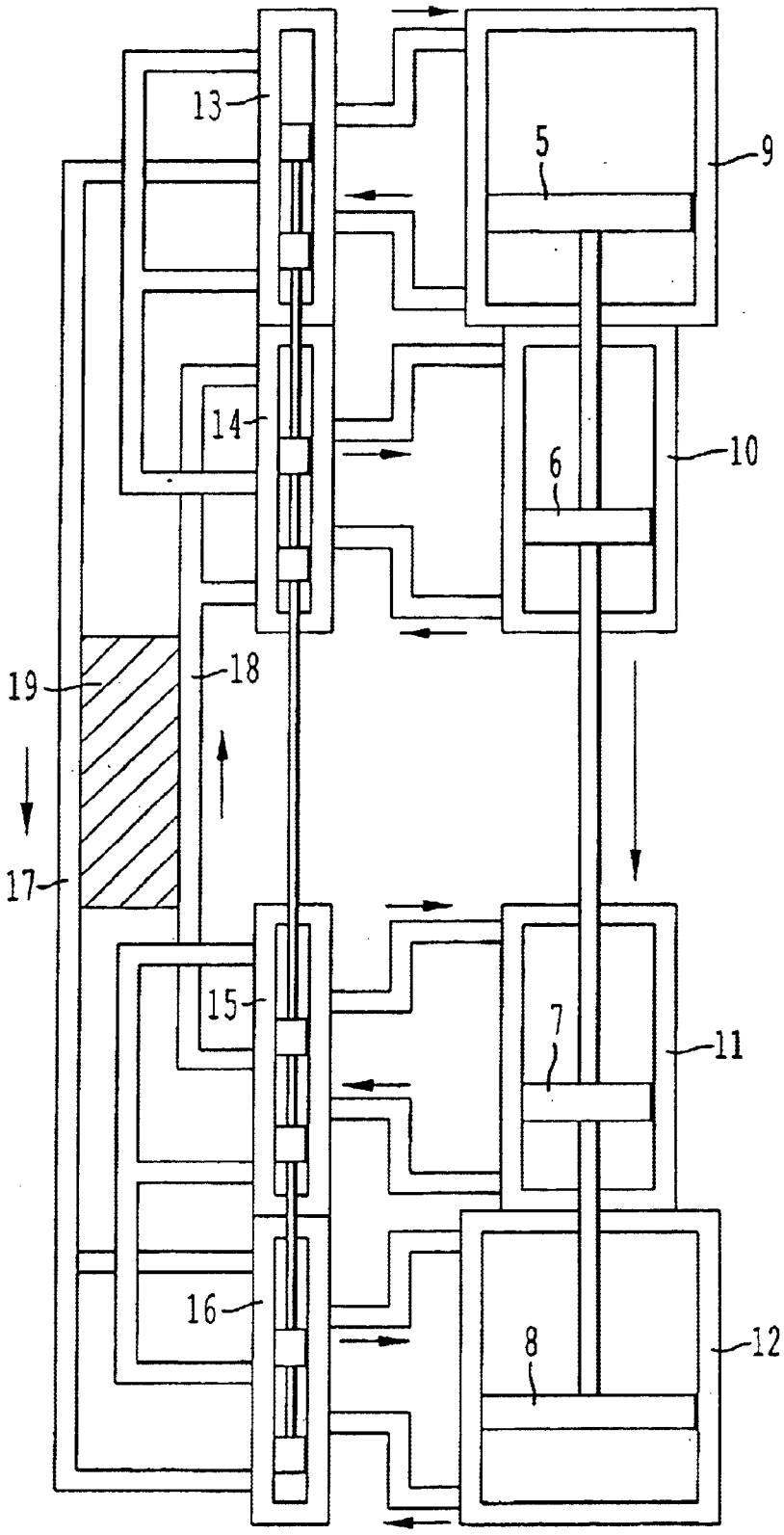
Figure 3:
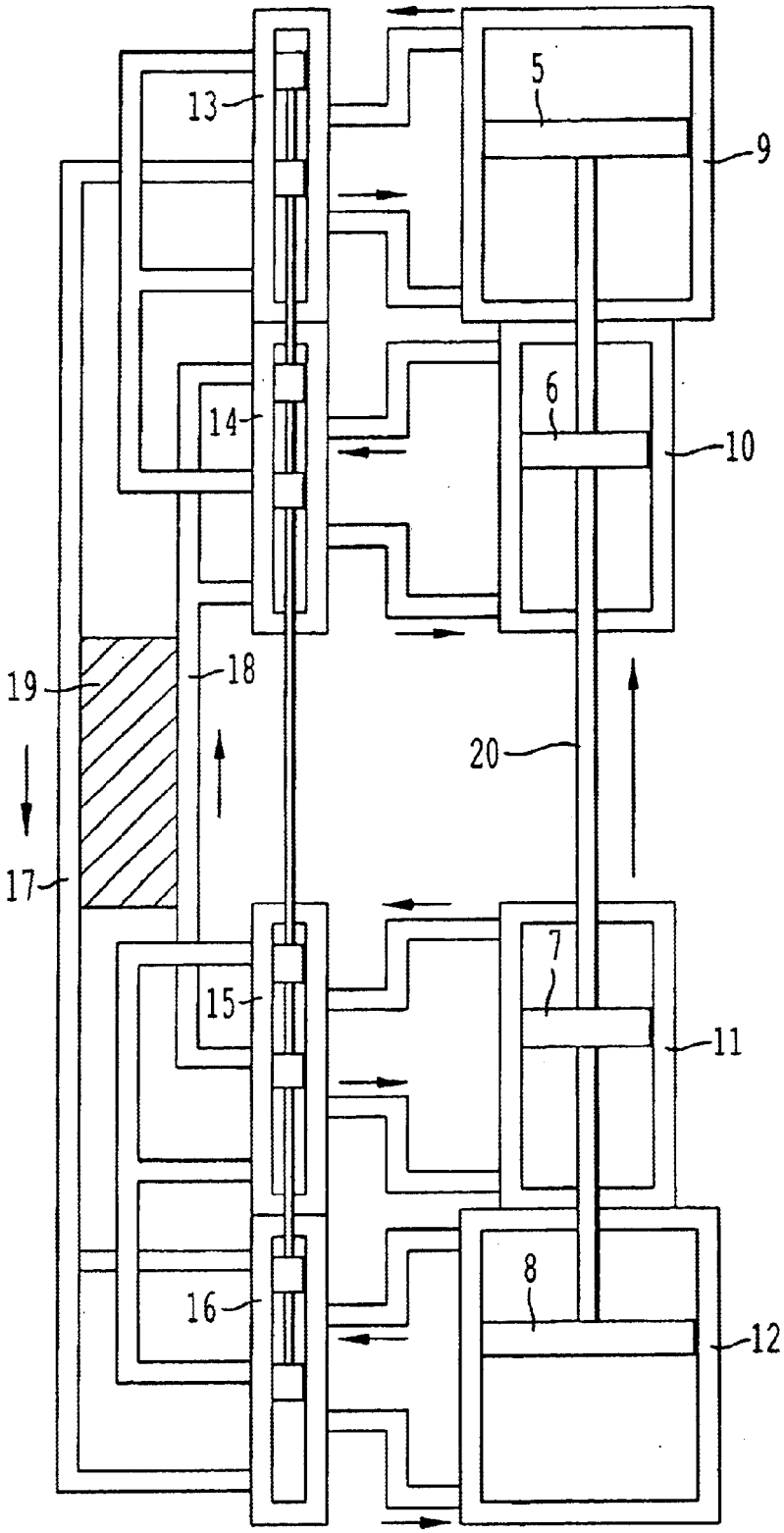
Figure 4:
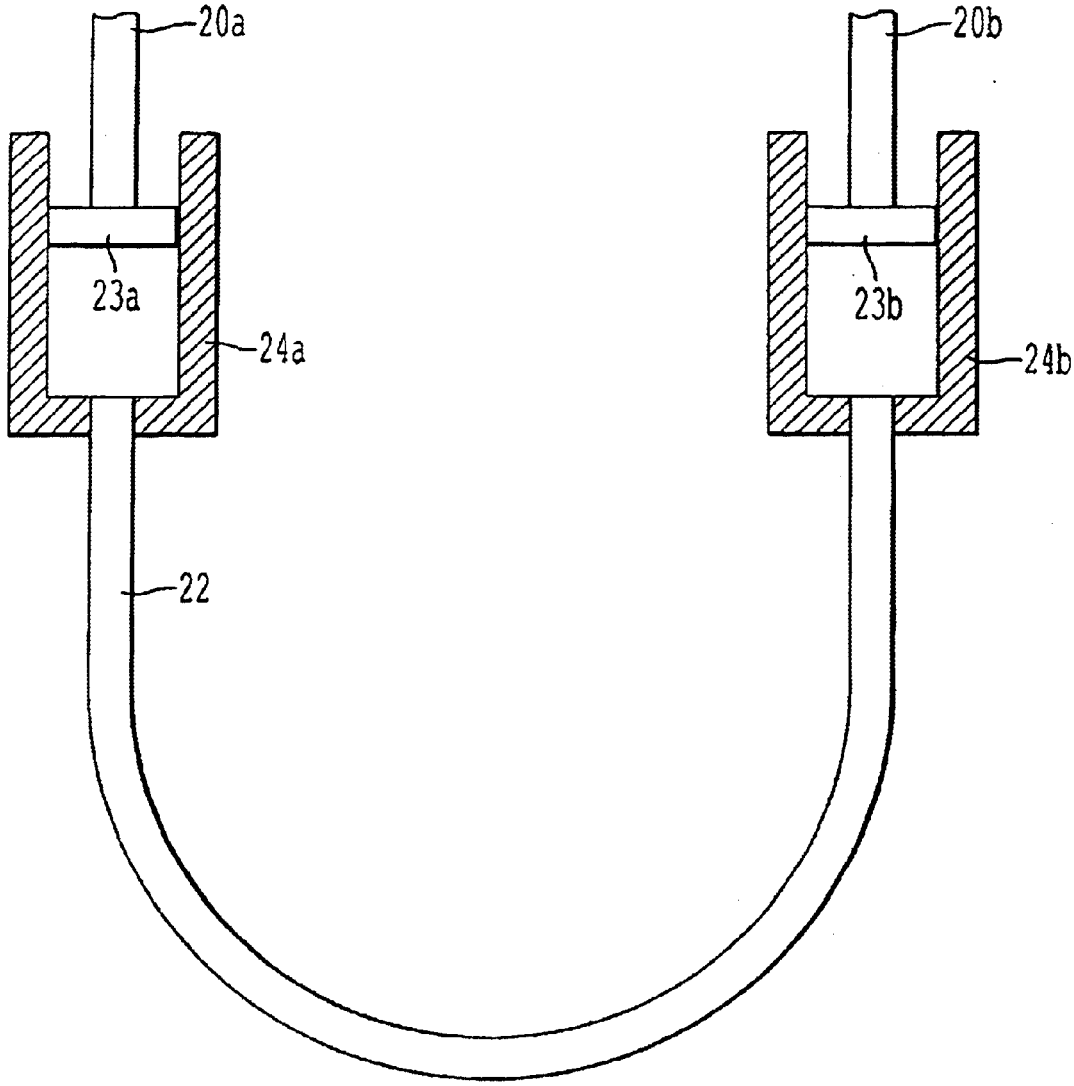

The invention will now be further explained with a reference to the figures, in which:

FIG. 1 represents a possible PV diagram of a Stirling cycle;

FIG. 2 schematically represents a Stirling motor or a heat pump according to the invention, during a down-going movement of the pistons;

FIG. 3 schematically represents a Stirling motor or a heat pump according to the invention, during an up-going movement of the pistons;

FIG. 4 schematically shows a hydraulic interconnection between the pistons.

FIG. 1 represents a possible PV diagram of a Stirling cycle, in which a volume of gas experiences an isothermal compression in a trajectory 1, next an isochorous heating in trajectory 2, next an isothermal expansion in trajectory 3 and finally an isochorous cooling in trajectory 4. In a Stirling motor according to the state of the art, the four trajectories are continuously passed through in a chronological order, while in a Stirling motor according to the invention all four trajectories are passed through simultaneously in a continuous manner.

FIG. 2 schematically represents a Stirling motor or a heat pump according to the invention, during a down-going movement of the pistons 5, 6, 7, 8 in cylinders 9, 10, 11, 12. Cylinders 9, 10, 11, 12 have been filled with a gas, which is selected such that, within a predefined determined temperature range, a large amount external work can be executed. For low temperatures, helium for example can be taken, while for higher temperatures for example R-12 and R-22 cooling fluids may be taken. In an up-going or down-going movement, the gas is transported, during which it must pass a number of double slide valves 13, 14, 15, 16.

Cylinders 9, 10 and slide valves 13, 14 constitute, together with the connecting lines, the hot motor part of the Stirling motor. To this part heat is supplied continuously, such that a temperature, $T_{high}$ is maintained. Cylinders 11, 12 and slide valves 15, 16 constitute, together with the connecting lines, the cold motor part of the Stirling motor. From this part heat is removed continuously, such that a temperature $T_{low}$, is maintained. Lines 17, 18 connect the hot motor part with the cold motor part; together they constitute a counterflow heat exchanger and for that purpose they are thoroughly interconnected by a bridge 19 with a very low heat resistance. For that purpose they may be made for example of copper and be soldered together over their entire length with the aid of silver solder.

Cylinders 9, 12 preferably have the same dimensions and cylinders 10, 11 preferably have also the same dimensions. Moreover it can easily be derived that preferably the ratio between the areas of piston 5 and piston 6 and of piston 8 and piston 7 should be taken equal to $T_{high}/T_{low}$.

With the slide valves positioned such as shown in the figure, gas will be pushed from the space underneath piston 6 to the space above piston 5 and thereby expand, in the process of which its temperature will remain equal to the temperature of the hot motor part $T_{high}$. Moreover, gas will be pushed from underneath piston 8 to the space above piston 7, in the process of which it will be compressed, while its temperature will remain the equal to the temperature of the cold motor part $T_{low}$. Also gas will be pushed from underneath piston 5, via line 17, to a space with the same volume above piston 8, in the process of which it will deliver heat to a gas which is pushed from a space underneath piston 7, via a line 18 to a space with the same volume above piston 6. Summarising, during a down-going movement of the pistons all four the trajectories of the Stirling cycle are passed through simultaneously.

FIG. 3 schematically represents a Stirling motor or a heat pump according to the invention, during an up-going movement of the pistons. With the slide valves positioned such as shown in the figure, gas will be pushed from the space above piston 6 to the space underneath piston 5 and thereby expand, in the process of which its temperature will remain equal to the temperature of the hot motor part $T_{high}$. Moreover, gas will be pushed from above piston 8 to the space underneath piston 7, in the process of which it will be compressed, while its temperature will remain equal to the temperature of the cold motor part $T_{low}$. Also gas will be pushed from above piston 5, via line 17, to a space with the same volume underneath piston 8, in the process of which it will deliver heat to a gas which is pushed from a space above piston 7, via a line 18 to a space with the same volume below piston 6. Summarizing, during a down-going movement of the pistons all four the trajectories of the Stirling cycle are passed through simultaneously.

It must be noted that a rod 20, which couples the pistons 5, 6, 7, 8, is connected to a flywheel in a manner well known in the art, and that a rod 21, which couples the slide valves 13, 14, 15, 16, is controlled for example by two cams on the flywheel, in such a manner that when the pistons 5, 6, 7, 8 have reached their lowest position, the slide valves assume the position as shown in FIG. 3, while when the pistons 5, 6, 7, 8 assume their highest position, the slide valves assume the position as shown in FIG. 2.

Instead of the slide valves, shown in FIG. 2 and FIG. 3, it is obviously possible to apply other types of valves, as long as they realize the functions as described with a reference to the figures. It may be advantageous for example to use electrically operated valves and to couple a position sensor or a speed sensor to rod 20. Instead of a rigid switch timing, derived from the flywheel, it is possible then to use for example a microprocessor to determine a more optimal switch timing, dependent upon the position and/or the speed of rod 20 and possibly upon $T_{high}$ and $T_{low}$.

With electrically operated valves the only rigid connection between the pistons in the hot motor part and the cold motor part is rod 20. FIG. 4 schematically shows a possible embodiment of a hydraulic interconnection between the pistons, which makes it possible to mount the cold motor part and the hot motor part separately, in such a manner that the only connections are the lines 17, 18 and a hydraulic interconnection 22. Rod 20 is divided then in a part 20*a*, connecting the pistons 5, 6 and a part 20*b*, connecting the pistons 7, 8. Part 20*a* is connected then to a small piston 23*a* and part 20*b* with a small piston 23*b*, which small pistons can move inside their respective small cylinders 24*a*, 24*b*. Small cylinders 24*a*, 24*b* and hydraulic interconnection 22 are, as usual, filled with hydraulic oil.

The description as given with a reference to FIGS. 1–3, specifically addresses the Stirling motor. It is known in the art that a Stirling engine also can be externally driven, in which manner a heat pump is obtained for which the description as given with a reference to FIGS. 1–3 applies substantially unchanged. Also known is that the trajectory of the PV diagram of FIG. 1 is passed through then the other way around.

What is claimed is:

1. A Stirling motor comprising:

a hot motor part comprising, a first pair of mutually coupled pistons, including a first large piston and a first small piston which are movable in a reciprocal manner, and a first assembly including a first large cylinder and a first small cylinder in which said first large piston and said first small piston respectively move, wherein said first assembly is configured to allow fluid to be exchanged between the first small cylinder and the first large cylinder;

a cold motor part comprising, a second pair of mutually coupled pistons, including a second large piston and a second small piston which are movable in a reciprocal manner, and a second assembly including a second large cylinder and a second small cylinder in which said second large piston and said second small piston respectively move, wherein said second assembly is configured to allow fluid to be exchanged between the second small cylinder and the second large cylinder;

a shaft or a hydraulic interconnection connecting the hot motor part and the cold motor part; and a counterflow heat exchanger coupled to said hot and cold motor parts by two tubes so as to mutually thermally interconnect the first large cylinder in said hot motor part with the second large cylinder in said cold motor part, and the second small cylinder in said hot motor part to the second small cylinder in said cold motor part.

2. The Stirling motor according to claim 1, wherein a ratio between the diameters of the first large piston and the first small piston and a ratio between the diameters of the second large piston and the second small piston substantially equal a ratio between an operational temperature of the hot motor part and an operational temperature of the cold motor part.

3. A Stirling motor according to claim 2, further comprising:

eight connections among the first large cylinder, the first small cylinder, the second large cylinder and the second small cylinder; and a system of valves mutually connecting the eight connections for executing a Stirling cycle.

4. A heat pump comprising:

a hot pump part comprising, a first pair of mutually directly coupled pistons, including a first large piston and a first small piston which are movable in a reciprocal manner, and a first assembly including a first large cylinder and a first small cylinder in which said first large piston and said first small piston respectively move, wherein said first assembly is configured to allow fluid to be exchanged between the first small cylinder and the first large cylinder;

a cold pump part comprising, a second pair of mutually directly coupled pistons, including a second large piston and a second small piston which are movable in a reciprocal manner, and a second assembly including a second large cylinder and a second small cylinder in which said second large piston and said second small piston respectively move, wherein said second assembly is configured to allow fluid to be exchanged between the second small cylinder and the second large cylinder;

a shaft or a hydraulic interconnection connecting the hot pump part and the cold pump part; and a counterflow heat exchanger coupled to said hot and cold pump parts by two tubes so as to mutually thermally interconnect the first large cylinder in said hot pump part with the second large cylinder in said cold pump part, and the second small cylinder in said hot pump part to the second small cylinder in said cold pump part.

5. The Stirling pump according to claim 4, wherein a ratio between the diameters of the first large piston and the first small piston and a ratio between the diameters of the second large piston and the second small piston substantially equals a ratio between an operational temperature of the hot pump part and an operational temperature of the cold pump part.

6. A Stirling pump according to claim 5, further comprising:

eight connections among the first large cylinder, the first small cylinder, the second large cylinder and the second small cylinder; and a system of valves mutually connecting the eight connections for executing a Stirling cycle.

* * * * *